US008047462B2

(12) United States Patent
Yamada

(10) Patent No.: US 8,047,462 B2
(45) Date of Patent: Nov. 1, 2011

(54) PAPER SUPPLY MECHANISM AND ROLL PAPER PRINTER

(75) Inventor: Masahiko Yamada, Omi-mura (JP)

(73) Assignee: Seiko Epson Corporation, Tokyo (JP)

( * ) Notice: Subject to any disclaimer, the term of this patent is extended or adjusted under 35 U.S.C. 154(b) by 172 days.

(21) Appl. No.: 12/290,763

(22) Filed: Nov. 3, 2008

(65) Prior Publication Data

US 2009/0114758 A1 May 7, 2009

(30) Foreign Application Priority Data

Nov. 5, 2007 (JP) ..... 2007-287009

(51) Int. Cl.
*B65H 75/24* (2006.01)

(52) U.S. Cl. ..... 242/578; 242/596.1; 242/423; 242/423.1; 242/523.2; 400/613

(58) Field of Classification Search ..... 242/578, 242/578.1–578.3, 595, 595.1, 594.1, 598.1, 242/596.1, 423, 423.1–423.3; 400/613
See application file for complete search history.

(56) References Cited

U.S. PATENT DOCUMENTS

| | | | | |
|---|---|---|---|---|
| 2,905,404 | A * | 9/1959 | Simmons | 242/423.2 |
| 6,695,500 | B2 * | 2/2004 | Kim et al. | 400/613 |
| 7,152,858 | B2 * | 12/2006 | Lin | 271/117 |
| 7,686,244 | B2 * | 3/2010 | Ando et al. | 242/566 |
| 2003/0170065 | A1 * | 9/2003 | Kim et al. | 400/718 |
| 2005/0098939 | A1 * | 5/2005 | Lin | 271/109 |
| 2007/0147936 | A1 * | 6/2007 | Ando et al. | 400/579 |

FOREIGN PATENT DOCUMENTS

| | | |
|---|---|---|
| EP | 1 798 050 A1 | 6/2007 |
| JP | 08-133540 | 5/1996 |
| JP | 2000-351493 | 12/2000 |
| JP | 2003-104568 | 4/2003 |
| JP | 2006-044900 | 2/2006 |
| JP | 2006-327826 | 12/2006 |
| JP | 2007-160801 | 6/2007 |
| JP | 2007-203563 | 8/2007 |

OTHER PUBLICATIONS

European Search Report dated Mar. 12, 2009.

* cited by examiner

*Primary Examiner* — Michael Mansen
*Assistant Examiner* — Juan Campos, Jr.
(74) *Attorney, Agent, or Firm* — Nutter McClennen & Fish LLP; John J. Penny, V.; Christina M. Sperry

(57) ABSTRACT

A paper supply mechanism comprising a roll paper compartment for storing roll paper, a first side wall that can move and defines one side of the roll paper compartment, a second side wall that defines the other side of the roll paper compartment, a lock mechanism that locks the first side wall, a roll paper urging member that urges the roll paper in a storage width direction of the roll paper compartment; and a holding mechanism that operates in conjunction with the lock mechanism and holds the roll paper urging member in a predetermined position.

18 Claims, 8 Drawing Sheets

PAPER SUPPLY MECHANISM AND ROLL PAPER PRINTER

This application claims priority under 35 U.S.C. §119 to Japanese Patent Application No. 2007-287009 filed on Nov. 5, 2007, the entire disclosure of which is expressly incorporated by reference herein.

BACKGROUND OF THE INVENTION

1. Field of Invention

The present invention relates to a paper supply mechanism that has a roll paper compartment for storing roll paper and supplies continuous printer paper from the roll paper compartment to the printing unit of a printer. The invention relates more particularly to a paper supply mechanism that enables the changing of the storage width of the roll paper compartment according to the paper width of the stored roll paper.

2. Description of Related Art

Roll paper printers used for issuing receipts, for example, use paper rolls having continuous printer paper wound into a roll as the recording medium. One type of roll paper supply mechanism used in such roll paper printers commonly uses a drop-in type roll paper compartment into which the paper supply roll is loaded from above and which allows the paper roll to rotate freely. Japanese Unexamined Patent Appl. Pub. JP-A-2006-44900 teaches a roll paper supply mechanism of this type that enables adjusting of the paper storage width by moving the left and right side walls that determine the storage width of the roll paper compartment.

With a drop-in type roll paper compartment, the inertial load of the roll paper and the friction between the roll paper and the bottom of the roll paper compartment must be overcome in order to make the roll paper roll deliver the paper from the roll paper compartment. The roll paper is fed by driving a paper feed roller disposed in the paper transportation path. The paper transportation load on the paper feed rollers increases as the paper speed increases, and can cause slippage between the paper feed roller and the paper, and which reduces paper transportation precision. To reduce the paper transportation load and enable conveying the paper precisely, Japanese Unexamined Patent Appl. Pub. JP-A-2007-203563 teaches a roll paper supply mechanism disposed to the bottom of the roll paper compartment that has a delivery roller for causing the roll paper to turn in the feed direction.

In the roll paper supply mechanisms of the related art described above, the side walls of the roll paper compartment can move. The side walls of the roll paper compartment are manually moved to positions corresponding to the paper width of the stored paper roll to adjust the storage width. However, because there are deviations in roll paper width and the roll paper supply mechanism, the storage width must be adjusted to accommodate these deviations.

If the storage width is too narrow after being adjusted, the side walls will push forcefully against the ends of the roll paper. This results in an excessive paper transportation load acting on the paper feed roller of the roll paper printer, for example, and therefore requires even greater force to deliver the printing paper from the paper roll.

However, if the storage width is too wide after being adjusted, the roll paper can shift side to side inside the roll paper compartment, which can result in the roll paper meandering or becoming skewed as it is delivered into the paper transportation path.

When a delivery roller is disposed in the roll paper compartment, the delivery roller is generally made from rubber or other material with a high coefficient of friction. In order to move the roll paper sideways (that is, along the width of the roll paper compartment) while in contact with the delivery roller while also moving the side walls, the roll paper must be pushed with enough force to overcome the friction between the roll paper and other parts when the paper roll is placed in the roll paper compartment and the side walls are then moved to adjust the width.

In addition, when the roll paper is on the delivery roller and the roll paper is shifted to one side, side pressure from friction with the delivery roller when the roll moves acts in addition to the side pressure from the side walls of the roll paper compartment, and the paper transportation load required to feed printing paper from the paper roll becomes excessive.

SUMMARY OF THE INVENTION

A roll paper supply mechanism according to the at least one embodiment of invention enables adjusting the storage width so that the roll paper can be stored with suitable side pressure even when there is deviation in the width of the roll paper.

A roll paper supply mechanism according to another aspect of at least one embodiment of the invention enables adjustment of the storage width so that the roll paper can be stored with suitable side pressure even when a delivery roller is used.

A roll paper supply mechanism according to a first aspect of at least one embodiment of the invention has a roll paper compartment for storing roll paper, a first side wall that can move and defines one side of the roll paper compartment, a second side wall that defines the other side of the roll paper compartment, a lock mechanism that locks the first side wall, a roll paper urging member that urges the roll paper widthwise to the roll paper compartment, and a holding mechanism that operates in conjunction with the lock mechanism and holds the roll paper urging member in a predetermined position.

Preferably, the roll paper supply mechanism also has a lock lever that moves between a locked position locking the lock mechanism and an unlocked position in which the lock is released. The roll paper urging member moves between a protruding position in which it protrudes a predetermined distance from the first side wall and a retracted position in which it is retracted a predetermined amount, and the holding mechanism holds the roll paper urging member in a position between the protruding position and the retracted position in conjunction with the lock lever moving to the unlocked position.

When roll paper of a different paper width than the roll paper currently used, for example, is loaded into the roll paper supply mechanism according to the at least one embodiment of invention, the lock lever is moved to the unlocked position so that the first side wall can be moved. The first side wall is then moved to a storage width position corresponding to the paper width of the roll paper to be stored. The lock lever is then operated again and returned to the locked position to hold the first side wall stationary.

When the lock lever moves to the unlocked position in this storage width adjustment operation, the holding mechanism holds the roll paper urging member at a position retracted from the protruding position to the retracted position side. The roll paper is thus not affected by the urging of the roll paper urging member, and the operator can move the first side wall until it stops at a position substantially matching the paper width. If the urging force of the roll paper urging member acts at this time, the operator might think that the first side wall met the stop because of this urging force, and may stop the first side wall at the wrong paper width position.

If the lock lever is returned to the locked position after moving the first side wall, the first side wall is held, and the roll paper urging member released by the holding mechanism and the roll paper urging member returns to being urged to the protruding position.

Even if the first side wall is moved and the roll paper is positioned, deviations in the roll paper supply mechanism and slippage when the operator returns the lock lever may produce a slight gap between the roll paper and the first side wall or second side wall, and the roll paper can shift sideways. There may also be variations in the paper width of the roll paper. However, the roll paper urging member of the at least one embodiment of invention pushes the roll paper to one side wall with appropriate force in such situations to eliminate any such play after the roll paper is positioned.

Furthermore, because the edge of the roll paper can be aligned to one side wall, problems caused by the roll paper shifting sideways or the paper meandering or becoming skewed when the roll paper is conveyed can be prevented.

If the range of roll paper urging member movement is set slightly greater than the deviation in the paper width of the roll paper or variations in the roll paper supply mechanism, the roll paper urging member can constantly apply suitable side pressure in the storage width direction even if there is variation in the paper width of the stored roll paper.

Further preferably, the holding mechanism has a lever-side engaging part formed on the lock lever, and an urging member-side engaging part disposed to the roll paper urging member. When the lock lever moves to the unlocked position, the lever-side engaging part engages the urging member-side engaging part and holds the roll paper urging member in the position between the protruding position and the retracted position.

Yet further preferably, the position between the protruding position and the retracted position is substantially centered between the protruding position and the retracted position. This configuration accommodates variation in the paper width of the roll paper whether the paper is narrower or wider.

The second side wall may also be movable. In this configuration, a linkage mechanism moves the second side wall in the opposite direction as the first side wall in conjunction with movement of the first side wall. This configuration can move the second side wall the same distance as the first side wall in the opposite direction.

Yet further preferably, the roll paper supply mechanism also has a delivery roller that touches the outside of the roll paper stored in the roll paper compartment, and causes the roll paper to rotate in the feed direction. The delivery roller includes a roller shaft disposed widthwise to the roll paper compartment, and a roller body attached to the roller shaft so that the roller body can slide a predetermined distance widthwise to the roll paper compartment.

When the roll paper is on the delivery roller and the first side wall is moved to adjust the storage width, the roll paper moves while rubbing against the delivery roller. Force sufficient to overcome the friction between the delivery roller and roll paper must therefore be applied to the first side wall to move the roll paper to the other second side wall in order to store the roll paper with no sideways play. This applies a high side pressure to the roll paper.

However, because the roller body in this aspect of the invention can slide widthwise relative to the roll paper compartment, the roller body slides together with the roll paper when the roll paper is moved widthwise to the roll paper compartment. The roll paper can therefore be easily moved widthwise to the roll paper compartment.

In another aspect of the invention the sliding distance of the roller body is substantially equal to the distance the roll paper urging member moves widthwise relative to the roll paper compartment.

Another aspect of at least one embodiment of the invention is a roll paper printer having the roll paper supply mechanism described above. This avoids problems caused by an increased paper transportation load as well as meandering and skewing of the printing position when roll paper of a different paper width is loaded. Furthermore, because the printing position can be conveyed more accurately, a drop in print quality caused by deficient roll paper transportation in the roll paper printer can also be prevented.

When the first side wall of a roll paper supply mechanism according to the at least one embodiment of invention is moved in the storage width direction in order to adjust the paper storage width of the roll paper compartment, a roll paper urging member disposed to the first side wall is held in a position between a protruding position and a retracted position. The first side wall and second side wall can therefore be positioned substantially at the width of the paper with the roll paper held therebetween. This position leaves a margin of movement (a range of movement) in the roll paper urging member in the protruding direction and retracting direction. A slight gap may, however, be formed between the roll paper and the first side wall or second side wall and the roll paper may be allowed to move sideways if there is variation in the paper width of the roll paper or in the roll paper supply mechanism, or if shifting occurs when the operator returns the lock lever. This gap and play can be absorbed, however, by the roll paper urging member moving and urging the roll paper. Play is therefore always removed, and a roll paper supply mechanism that can store the roll paper with pressure applied by a predetermined urging force can be achieved.

Other objects and attainments together with a fuller understanding of the invention will become apparent and appreciated by referring to the following description and claims taken in conjunction with the accompanying drawings.

DESCRIPTION OF PREFERRED EMBODIMENTS

A roll paper printer that has a roll paper supply mechanism according to the at least one embodiment of invention is described below with reference to the accompanying figures.

General Configuration

Figure 1:
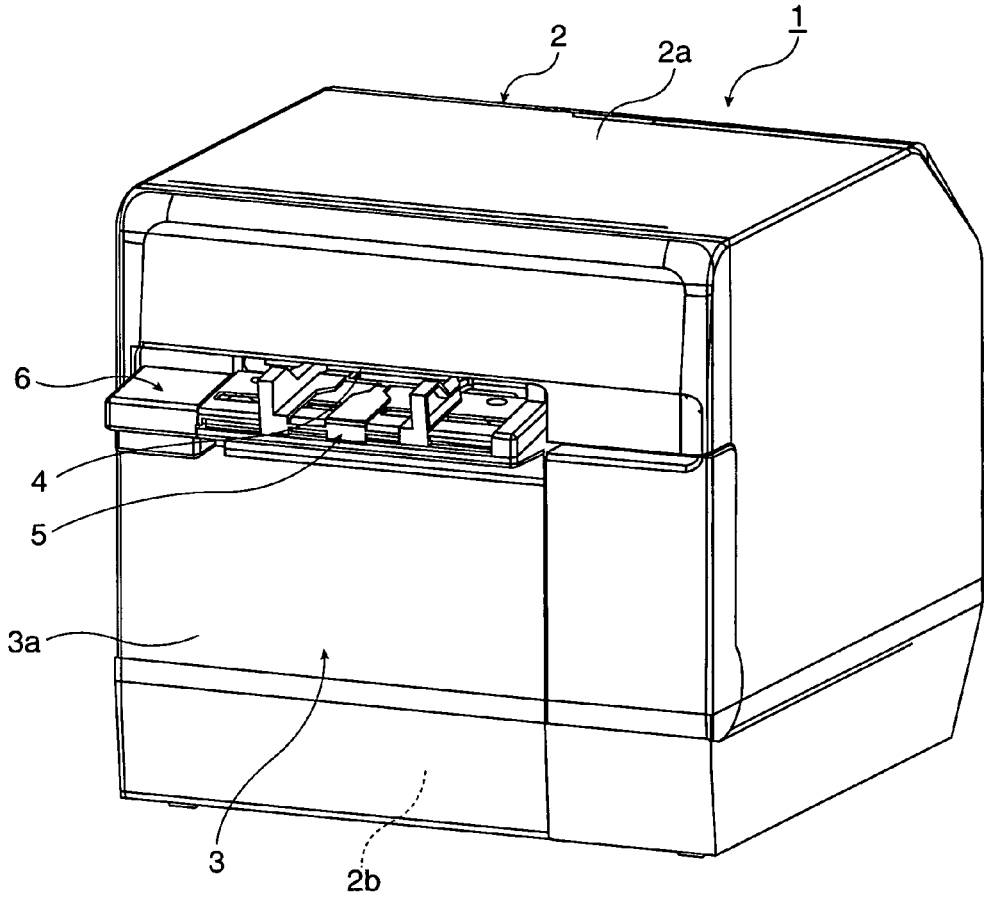
FIG. 1 is an external oblique view of a roll paper printer according to a preferred embodiment of the at least one embodiment of invention.
Figure 2:
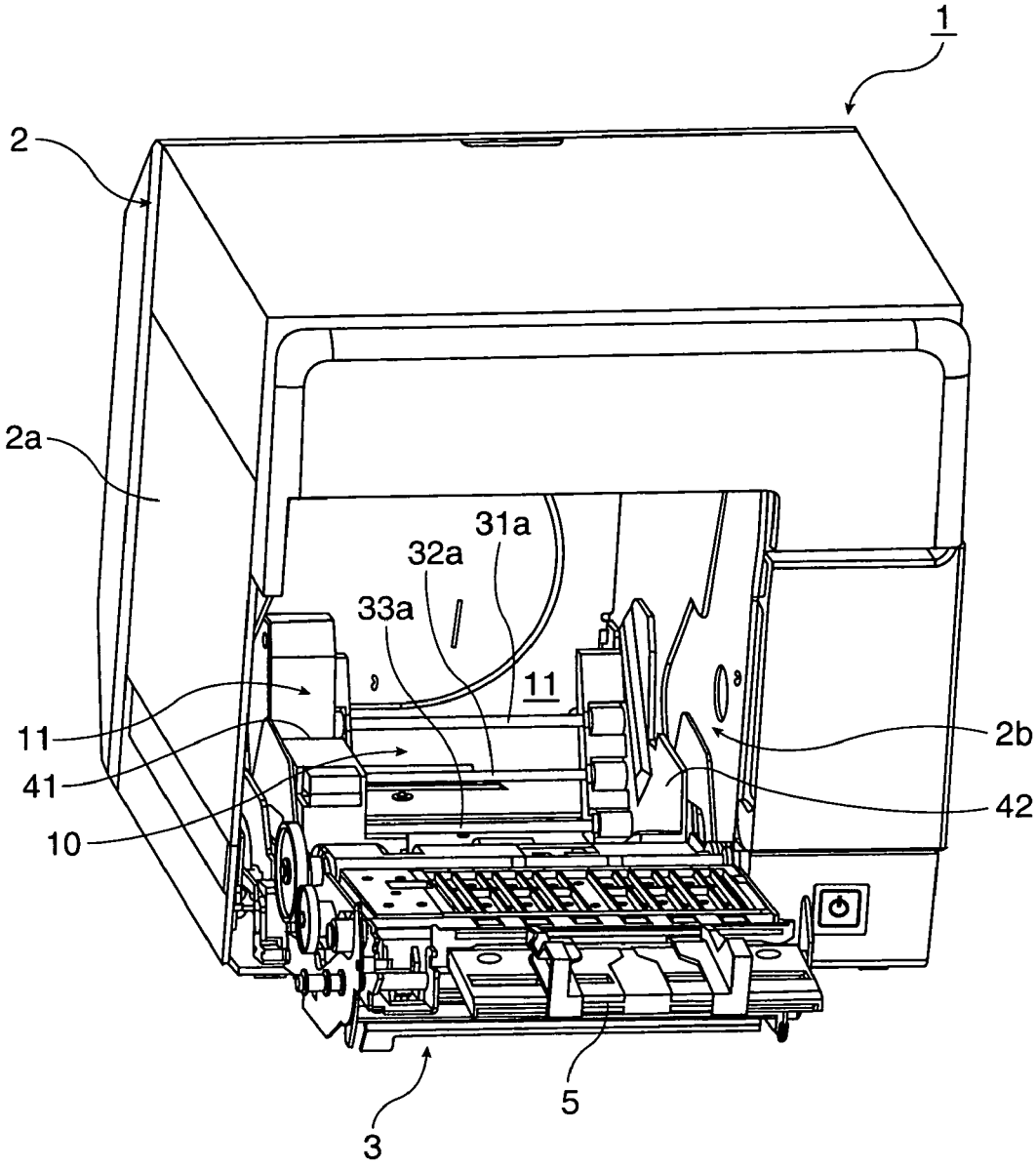
FIG. 2 is an external oblique view of the roll paper printer in FIG. 1 with the cover unit open.

FIG. 1 is an oblique view showing an inkjet roll paper printer according to a first embodiment of invention. FIG. 2 is an oblique view of the same printer with the cover open.

The roll paper printer 1 has a rectangular box-like case 2 and a cover unit 3 that opens and closes and is disposed to the front of the case 2. A paper exit 4 of a specific width is formed at the front of the outside case 2*a* part of the printer case 2. An exit guide 5 projects to the front from the bottom of the paper exit 4, and a cover opening lever 6 is disposed beside the exit guide 5. A rectangular opening 2*b* for loading and removing roll paper is formed in the outside case 2*a* below the exit guide 5 and cover opening lever 6, and this opening 2*b* is closed by the cover case 3*a* of the cover unit 3.

Operating the cover opening lever 6 unlocks the cover unit 3. When the lock is released and the exit guide 5 is pulled forward, the cover unit 3 pivots at the bottom end part thereof and opens forward to a substantially horizontal position. When the cover unit 3 opens, the roll paper compartment 11 of the roll paper supply mechanism 10 assembled inside the printer become open as shown in FIG. 2. The paper transportation path from the roll paper compartment 11 to the paper exit 4 also opens, and the roll paper can be easily replaced from the front of the printer. Note that the cover case 3*a* of the cover unit 3 and the cover opening lever 6 are not shown in FIG. 2.

Figure 3:
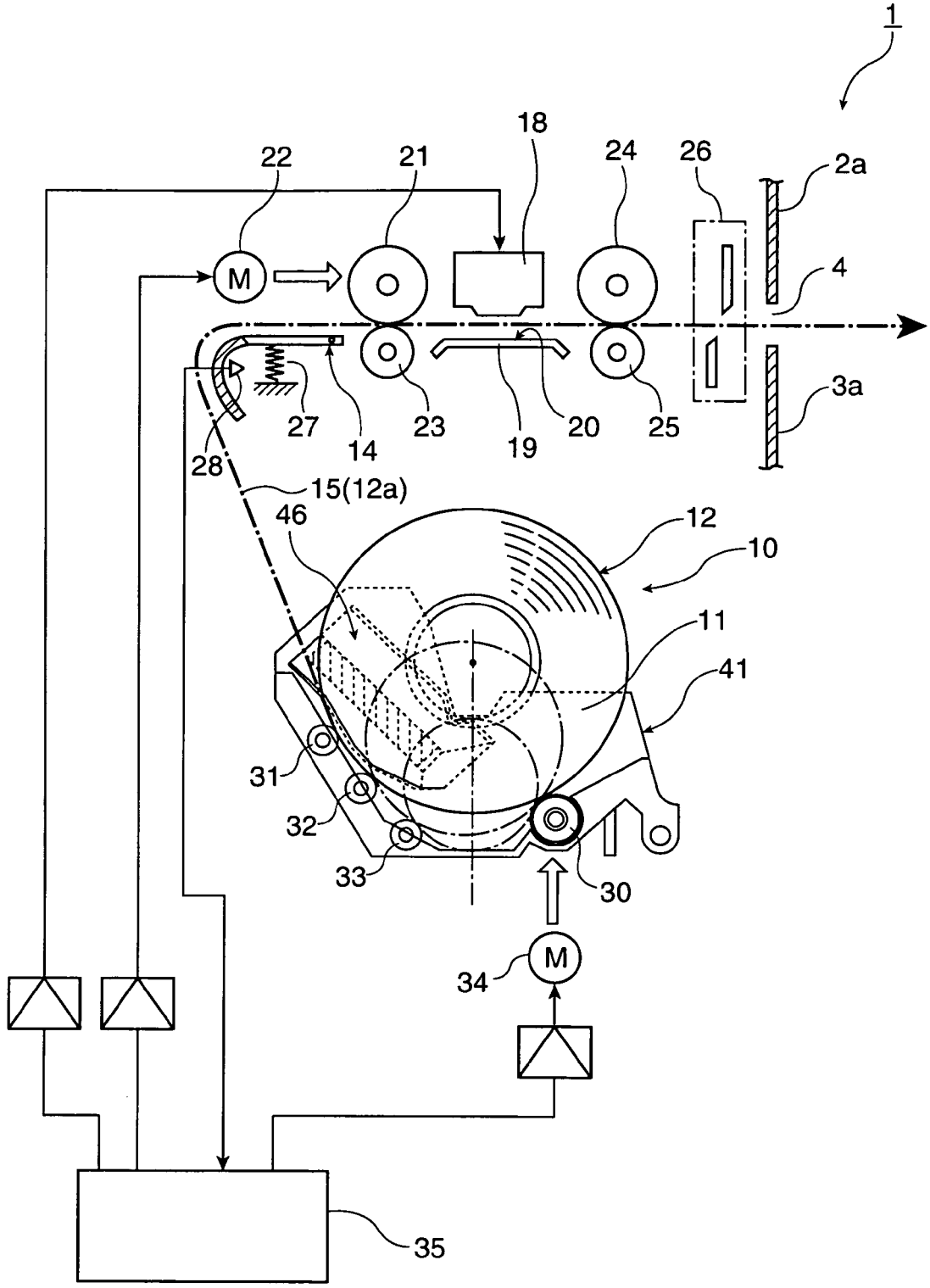
FIG. 3 describes the internal configuration of the roll paper printer shown in FIG. 1.

FIG. 3 describes the internal structure of the roll paper printer 1. The roll paper supply mechanism 10 assembled inside the roll paper printer 1 has a roll paper compartment 11 disposed in the middle between the sides of the printer case 2. The roll paper 12 is stored inside the roll paper compartment 11 so that it can roll horizontally through the printer with the center of the roll aligned widthwise to the printer. The roll paper 12 is a length of printing paper 12*a* (indicated by the bold dot-dash line in FIG. 3) wound into a roll. The printing paper 12*a* is pulled off the roll paper 12 stored in the roll paper compartment 11, travels diagonally up and around a curved paper guide 14 and then travels horizontally through the paper transportation path 15 (the same path as the dot-dash line indicating the printing paper 12*a*) and out from the paper exit 4.

The horizontal portion of the paper transportation path 15 is positioned directly above the roll paper supply mechanism 10. The inkjet head 18 and platen 19 are disposed to this horizontal portion of the transportation path opposite each other with a predetermined gap therebetween, and the platen 19 determines the printing position 20 of the inkjet head 18.

An upstream paper feed roller 21 is disposed in the paper transportation path 15 on the upstream side of the inkjet head 18, and the upstream paper feed roller 21 is driven by a paper transportation motor 22. A pressure roller 23 that rotates in conjunction with the upstream paper feed roller 21 is pressed to the upstream paper feed roller 21 with the printing paper 12*a* therebetween. A downstream paper feed roller 24 that rotates in synchronization with the upstream paper feed roller 21 is disposed on the downstream side of the inkjet head 18, and a pressure roller 25 that rotates in conjunction with the downstream paper feed roller 24 is pressed to the downstream paper feed roller 24 with the printing paper 12*a* therebetween. An automatic paper cutter 26 is disposed near the paper exit 4, and horizontally cuts the leading end part of the printed printing paper 12*a* to a specific length.

The paper guide 14 is mounted movably within a predetermined range to a printer frame not shown, and is constantly urged by a spring member 27 in the direction applying tension to the printing paper 12*a*. The printing paper 12*a* conveyed through the paper transportation path 15 is thus held with constant tension applied thereto. A guide sensor 28 is disposed near the paper guide 14, and if slack develops in the printing paper 12*a* and the paper guide 14 moves in the direction urged by the spring member 27, this movement of the paper guide 14 is detected by the guide sensor 28.

The roll paper compartment 11 of the roll paper supply mechanism 10 has a single delivery roller 30 and a plurality of guide rollers. In this embodiment of the invention, there are three guide rollers, specifically first to third guide rollers 31 to 33. The delivery roller 30 is driven by a delivery motor 34. The three (first to third) guide rollers 31 to 33 are supported so that they can rotate freely.

The drive control unit 35 of the roll paper printer 1 is connected to a host device such as a computer system not shown, and controls driving other parts of the roll paper printer 1 based on commands received from the host. In the printing operation, the paper transportation motor 22 is driven to rotationally drive the upstream paper feed roller 21 and the downstream paper feed roller 24, drive the delivery motor 34 of the roll paper supply mechanism 10 rotationally in conjunction with the feed rollers, and thereby convey the printing paper 12*a*. The drive control unit 35 also drives the inkjet head 18 synchronized to printing paper 12*a* to print to the surface of the printing paper 12*a* as the paper passes the printing position 20. After printing ends, the drive control unit 35 drives the automatic paper cutter 26 to cut the printing paper 12*a*. This results in a receipt or ticket, for example, obtained by cutting the printing paper 12*a* to a specific length, being issued from the paper exit 4.

Based on detection signals from the guide sensor 28, the drive control unit 35 controls driving of the delivery roller 30 of the roll paper supply mechanism 10 synchronized to the upstream paper feed roller 21 and downstream paper feed roller 24 so that the printing paper 12*a* is conveyed with no slack and constant tension is applied thereto.

Figure 4A:
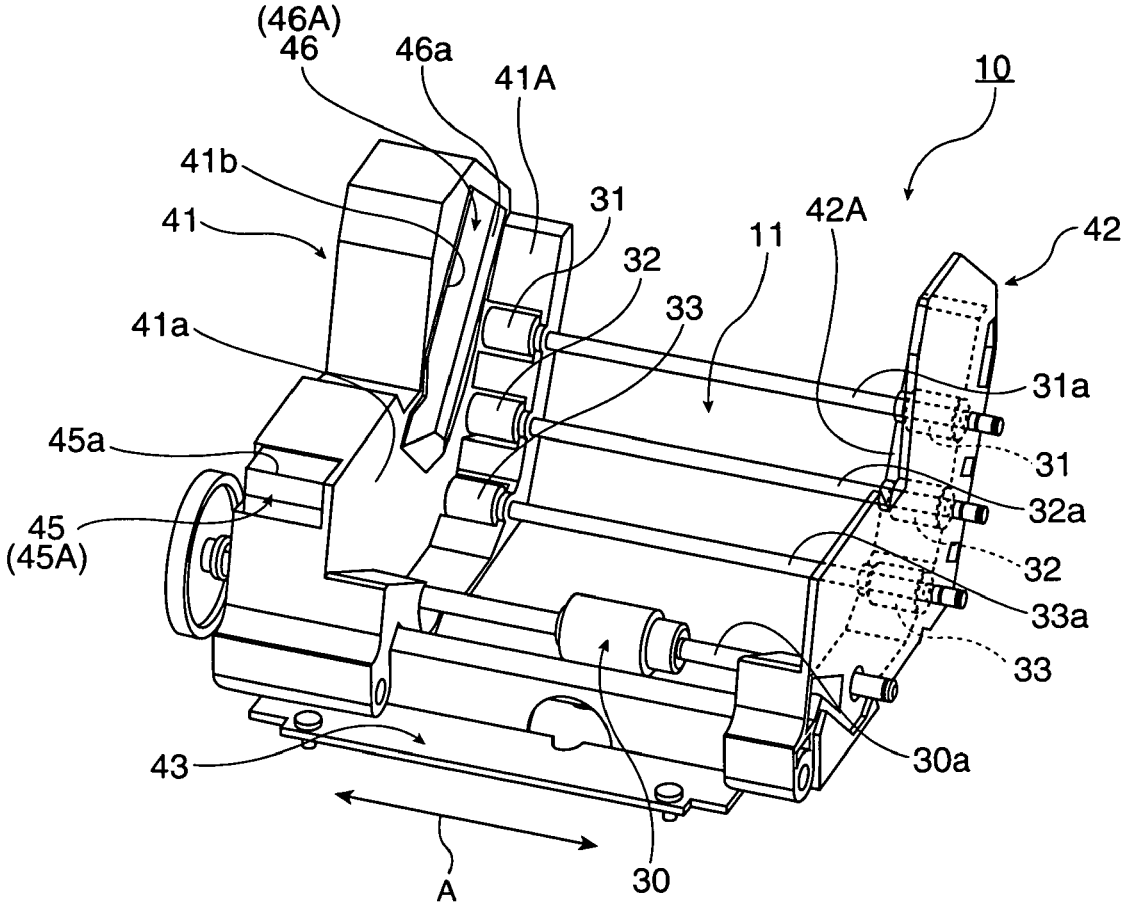
FIG. 4A and FIG. 4B are oblique views showing the roll paper supply mechanism of the roll paper printer in FIG. 1.

FIG. 4A is an oblique view showing the major parts of the roll paper supply mechanism 10. The roll paper compartment 11 of the roll paper supply mechanism 10 has a first side wall 41 and a second side wall 42 that define the storage width on the left and right sides. The front end parts of the first side wall 41 and second side wall 42 can slide along a guide plate 43, which is attached to a printer frame not shown in line with the storage width A (the lateral dimension widthwise to the printer). Roller shafts 30*a*, 31*a*, 32*a*, 33*a* also extend horizontally in the storage width direction passing through the front bottom end parts and back end parts of the first side wall 41 and second side wall 42. The first side wall 41 and second side wall 42 can slide along these roller shafts 30*a* to 33*a* in the storage width direction.

The roller shaft 30*a* is the roller shaft of the delivery roller 30, and a delivery roller 30 is coaxially attached to the roller shaft 30*a* at a position in the middle of the roller shaft 30*a* in the storage width direction. The ends of the roller shaft 30*a* are supported freely rotationally by the printer frame not shown. The three roller shafts 31*a* to 33*a* are respectively the shafts of the first to third guide rollers 31 to 33, and the shaft ends are supported by the printer frame not shown.

Bottom portions 41A and 42A of a specific width are formed at the bottom inside edges of the first side wall 41 and second side wall 42. The first to third guide rollers 31 to 33 that are supported freely rotationally coaxially to the roller shafts 31*a* to 33*a* are supported on the bottom portions 41A and 42A, and can move with the first side wall 41 and second side wall 42 in the storage width direction.

A lock lever 45 and a roll paper urging member 46 are assembled in the first side wall 41. The distal end 45*a* of the lock lever 45 is exposed at the front top part of the first side wall 41. The lock lever 45 locks the first side wall 41 to the guide plate 43 so that the first side wall 41 does not move in the storage width direction. When the distal end 45*a* is manually depressed, the lock lever 45 unlocks and the first side wall 41 can move in the storage width direction. A substantially rectangular window 41*b* is formed in the inside surface 41*a* of the first side wall 41, and the roll paper urging member 46 protrudes through this window 41*b* toward the inside of the roll paper compartment 11.

The distal end part of the roll paper urging member 46 has a trapezoidal shape in section, and the roll paper urging member 46 is constantly urged toward the second side wall 42 by an elastic force. The roll paper urging member 46 can protrude to a protruding position 46A shown in FIG. 4A, and can be pushed in to a retracted position where the end face 46*a* of the roll paper urging member 46 is flush with the surface 41*a* of the first side wall 41.

Figure 4B:
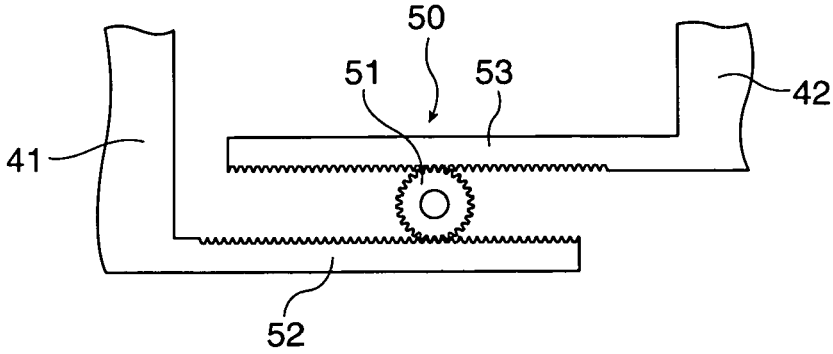

FIG. 4B shows the linking mechanism connecting the first side wall 41 and second side wall 42. This linking mechanism 50 has a pinion 51, which is supported freely rotatably at a predetermined position, and a first rack 52 and second rack 53 that mesh with the pinion 51 from opposite sides. The first and second racks 52 and 53 extend along the storage width direction, the first rack 52 is connected to the first side wall 41, and the second rack 53 is connected to the second side wall 42.

When the first side wall 41 moves in the storage width direction, the second side wall 42 moves in conjunction therewith an equal distance in the opposite direction.

A different mechanism can be used for this linking mechanism. Further alternatively, the first side wall 41 may be movable while the second side wall 42 is stationary, or vice versa. The positions of the first side wall 41 and second side wall 42 may also be reversed right and left.

Lock Lever and Roll Paper Urging Member

Figure 5:
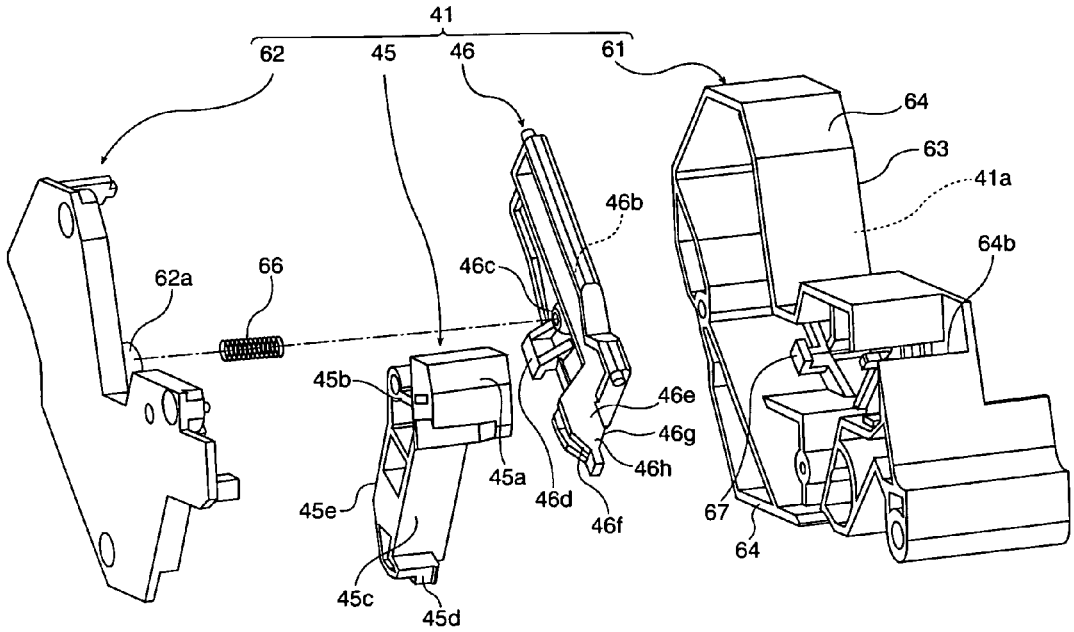
FIG. 5 is an exploded oblique view of a first side wall of the roll paper supply mechanism in FIG. 4.

FIG. 5 is an exploded oblique view showing the main parts of the first side wall 41.

The first side wall 41 has a main unit 61, a side plate 62 that attaches to the main unit 61, and the lock lever 45 and roll paper urging member 46 assembled inside the main unit 61.

The main unit 61 basically includes a side wall part 63 to which the inside surface 41*a* is formed, and an outside wall part 64 extending perpendicularly from the outside edge part of the side wall part 63. The outline of the side plate 62 corresponds to the outside wall part 64, and the side plate 62 is fastened to the outside wall part 64 by a screw, for example, not shown.

Figure 6A:
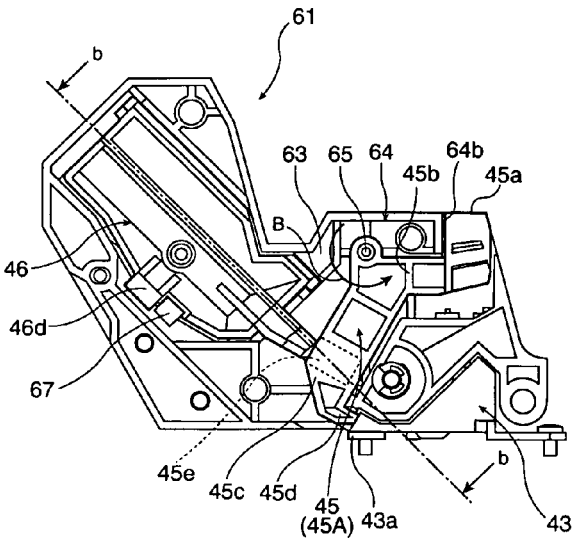
FIG. 6A, 6B and FIG. 6C describe the internal structure of the first side wall of the roll paper supply mechanism in FIG. 4A.
Figure 6B:
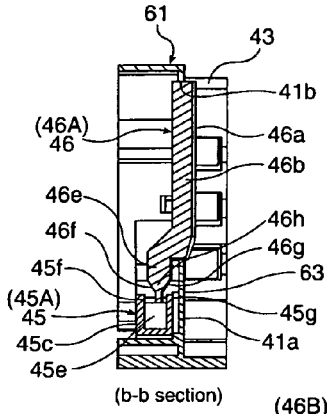
Figure 6C:
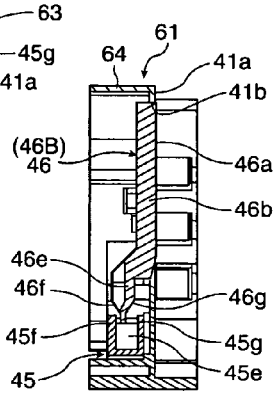

FIG. 6A is a side view showing the lock lever 45 and roll paper urging member 46 assembled to the main unit 61. FIG. 6B and FIG. 6C are section views through line b-b in FIG. 6A, and respectively show the roll paper urging member 46 in the protruding position 46A and the retracted position 46B.

FIG. 5, FIG. 6A, FIG. 6B, and FIG. 6C are referred to below. The lock lever 45 is attached to pivot up and down on a support pin 65, which protrudes perpendicularly from the back side of the side wall part 63 of the main unit 61. The end of the arm 45*b* extending forward from the support pin 65 part of the lock lever 45 curves upward, forming an operating end part 45*a*. This operating end part 45*a* is exposed from an opening 64*b* formed in the outside wall part 64 of the main unit 61. A locking claw 45*d* is formed on the end of the arm 45*c* extending down and to the back from the support pin 65 part of the lock lever 45.

The lock lever 45 is constantly urged in the direction of arrow B in FIG. 6A by a spring member not shown. Notches 43*a* are formed at a plurality of locations at predetermined intervals in the storage width direction of the roll paper compartment 11 in the side of the guide plate 43 opposite the locking claw 45*d*. The lock lever 45 is held by the force of the spring with the locking claw 45*d* engaged with one of the notches 43*a* in a locked position 45A.

When the operating end part 45*a* of the lock lever 45 is manually depressed, the lock lever 45 can pivot on the support pin 65 in the opposite direction as arrow B against the force of the spring. When the lock lever 45 pivots in the opposite direction as indicated by arrow B, the locking claw 45*d* separates from the notches 43*a* and the first side wall 41 can be moved in the storage width direction.

As shown in FIG. 5, the roll paper urging member 46 has a long, narrow, rectangular distal end part 46*b* with a trapezoidal shape in section, and this distal end part 46*b* protrudes to the inside of the roll paper compartment 11 from a window 41*b* formed in the side wall part 63 of the main unit 61 (see FIG. 4A). As shown in FIG. 5, a cylindrical spring receiver 46*c* is formed on the back side of the distal end part 46*b*. A cylindrical spring receiver 62*a* is also formed on the side plate 62 at a position opposite the spring receiver 46*c*, and a coil spring 66 is held compressed between the spring receivers 46*c* and 62*a*.

A contact plate 46*d* that can contact the edge part of the window 41*b* in the main unit 61 from the back side is formed on the roll paper urging member 46. The position where the contact plate 46*d* touches the edge of the window 41*b* determines the protruding position 46A of the roll paper urging member 46.

A contact plate 67 that protrudes to the back side from the edge of the window 41*b* in the main unit 61 is formed at a position proximal to the contact plate 46*d*. The position where the contact plate 67 touches the roll paper urging member 46 determines the retracted position 46B of the roll paper urging member 46.

In FIG. 6C the roll paper urging member 46 is shown in the retracted position 46B, and in this position the end face 46*a* of the roll paper urging member 46 is substantially flush with the surface 41*a* of the first side wall 41.

The roll paper urging member 46 can move in the storage width direction of the roll paper compartment 11 in the range between the protruding position 46A and retracted position 46B defined by the contact plates 46*d* and 67.

When the lock lever 45 is in the locked position 45A, the roll paper urging member 46 urges the roll paper 12 toward the second side wall 42 while moving between the protruding position 46A and retracted position 46B.

An urging member-side engaging part 46*e* that protrudes toward the bottom arm 45*c* of the lock lever 45 is formed on the roll paper urging member 46. The distal end part of the urging member-side engaging part 46*e* narrows toward the end between left and right tapered surfaces 46*f* and 46*g*. The arm 45*c* of the lock lever 45 is disposed on the end of the urging member-side engaging part 46*e*. A channel-shaped lever-side engaging part 45*e* is formed in the arm 45*c* of the lock lever 45 as an opening facing the urging member-side engaging part 46*e*. Left and right distal ends 45*f* and 45*g* in the open side of the lever-side engaging part 45*e* respectively face the left and right tapered surfaces 46*f* and 46*g* on the roll paper urging member side.

Figure 7A:
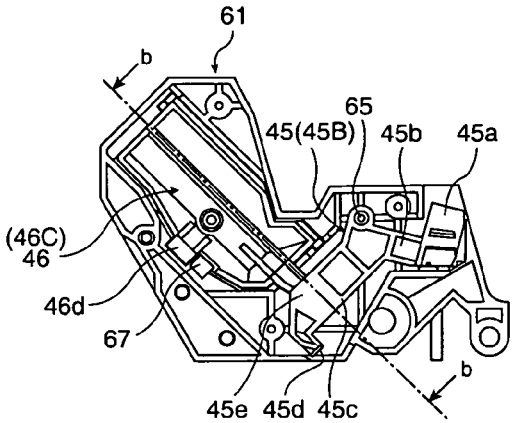
FIG. 7A and FIG. 7B describe the operation of the lock lever of the roll paper supply mechanism in FIG. 4A.

Similarly to FIG. 6A and FIG. 6B, FIG. 7A and FIG. 7B are a side view of the lock lever 45 and roll paper urging member 46 assembled to the main unit 61 and a section view through line b-b in FIG. 7A, respectively.

When the operating end part 45*a* of the lock lever 45 is manually depressed, the lock lever 45 pivots on the support pin 65, and the lower arm 45*c* moves in the direction separating from the guide plate 43. As a result, the lock lever 45 moves to the unlocked position 45B where the locking claw 45*d* on the distal end of the arm 45*c* is released from the notches 43*a* in the guide plate 43. From this position the first side wall 41 can be moved in the storage width direction of the roll paper compartment 11.

Figure 7B:
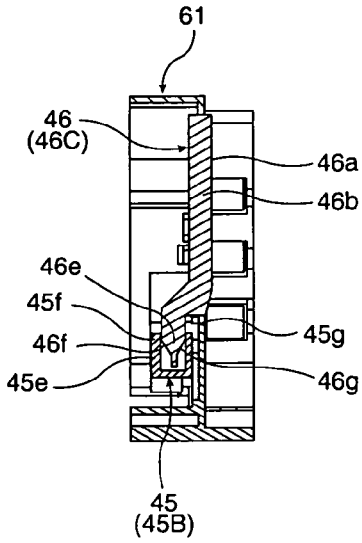

When the lock lever 45 pivots toward the unlocked position 45B as shown in FIG. 7B, the left and right distal ends 45*f* and 45*g* of the lever-side engaging part 45*e* of the arm 45*c* move in the direction approaching the left and right tapered surfaces 46*f* and 46*g* of the urging member-side engaging part 46*e* of the roll paper urging member 46.

FIG. 6B and FIG. 6C show the lock lever 45 held in the locked position 45A. The operation whereby the lock lever 45 in FIG. 7B moves from this locked position 45A to the unlocked position 45B is described next. When the roll paper urging member 46 is protruding in the protruding position 46A shown in FIG. 6B (the end face 46*a* of the roll paper urging member 46 is not touching the roll paper 12) and the lock lever 45 moves to the unlocked position 45B, the lever-side engaging part 45*e* of the lock lever 45 rises, the distal end 45*g* on the right side of the lever-side engaging part 45*e* contacts the right side taper 46*g* of the urging member-side engaging part 46*e*, and moves while pushing the taper 46*g* to the left.

When the roll paper urging member 46 is retracted to the retracted position 46B shown in FIG. 6C (where the end face 46*a* of the roll paper urging member 46 touches the roll paper 12), however, the left side distal end 45*f* contacts the left side taper 46*f*, and moves while pushing the taper 46*f* to the right.

Whether the roll paper urging member 46 is in position 46A or 46B, when the lock lever 45 is depressed to the unlocked position 45B, the urging member-side engaging part 46*e* of the roll paper urging member 46 is inserted to and held in the channel in the lever-side engaging part 45*e* of the lock lever 45. The position of the roll paper urging member 46 at this time in this example is controlled to a neutral position 46C between the protruding position 46A and retracted position 46B. The roll paper urging member 46 may obviously be positioned offset to the left or right side from this center position.

The lever-side engaging part 45*e* and the urging member-side engaging part 46*e* in this embodiment of the invention thus form a holding mechanism that holds the roll paper urging member 46 in a neutral position 46C. When the lock lever 45 is set to the unlocked position 45B so that the first side wall 41 can move, the roll paper urging member 46 is fixed to the first side wall 41. As a result, the first side wall 41 can be moved to shift the roll paper 12 to the second side wall 42 side without being affected by the urging force of the roll paper urging member 46, and the first side wall 41 and second side wall 42 can be adjusted substantially to the width of the roll paper 12. The lock lever 45 can then be set to the locked position 45A to lock the first side wall.

Delivery Roller

Figure 8A:
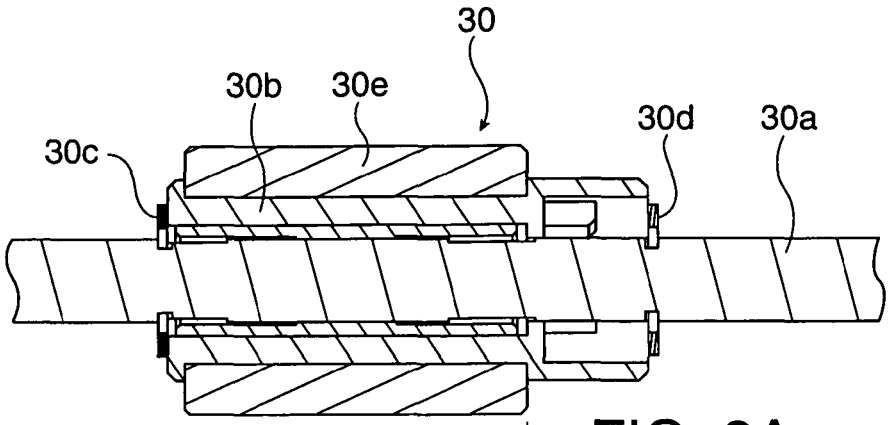
FIG. 8A and FIG. 8B are longitudinal section views of the delivery roller in the roll paper supply mechanism in FIG. 4A.
Figure 8B:
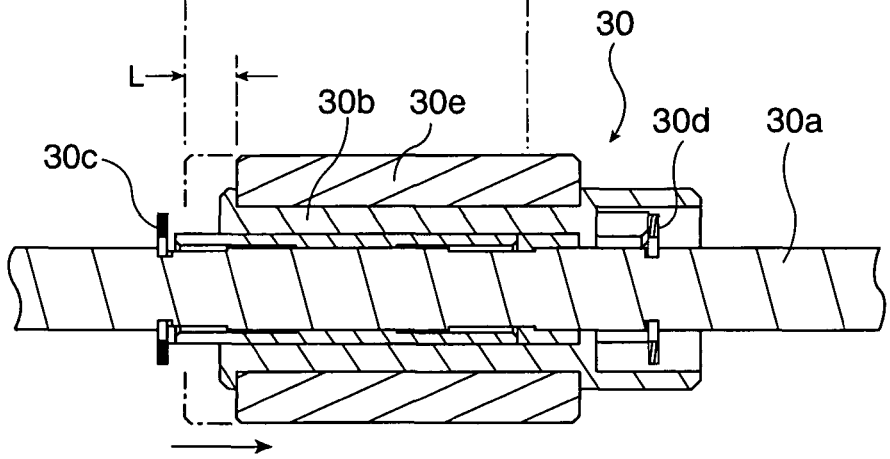

FIGS. 8A and 8B are a longitudinal section views of the delivery roller 30. The delivery roller 30 is attached to rotate in unison with the roller shaft 30*a*. Also attached to the roller shaft 30*a* are a slide cylinder 30*b*, left and right snap rings 30*c* and 30*d*, and a rubber roller body 30*e*. The slide cylinder 30*b* can slide along the axial direction (storage width direction) of the roller shaft 30*a*, and the snap rings 30*c* and 30*d* determine the sliding range of the slide cylinder 30*b*. The roller body 30*e* concentrically surrounds the outside of the slide cylinder 30*b*. The slide cylinder 30*b* is also constantly urged toward the first side wall 41 by a spring member not shown.

When the delivery roller 30 thus configured is pushed toward the second side wall 42, the roller body 30*e* can slide together with the slide cylinder 30*b* in the direction of the arrow as shown in FIG. 8B. This sliding distance L is equal to the distance that the roll paper urging member 46 moves, that is, the distance from the protruding position 46A to the retracted position 46B. These distances may also be different.

Changing the Storage Width

The operation whereby the storage width of the roll paper compartment 11 in the roll paper supply mechanism 10 of the roll paper printer 1 described above is changed is described below.

When the roll paper 12 is not loaded and the roll paper compartment 11 is empty, the lock lever 45 is in the locked position 45A and the roll paper urging member 46 is in the protruding position 46A as shown in FIG. 6A and FIG. 6B. The operating end part 45*a* of the lock lever 45 exposed from the top front part of the first side wall 41 is then depressed to move the lock lever 45 to the unlocked position 45B (FIG. 7B). As a result, the first side wall 41 can move in the storage width direction. When the urging member-side engaging part 46*e* of the roll paper urging member 46 is then pushed by the lever-side engaging part 45*e* of the lock lever 45, the roll paper urging member 46 is pushed from the protruding position 46A toward the retracted position 46B, and is held stationary at the neutral position 46C (see FIG. 7B).

The roll paper 12 is then loaded in the roll paper compartment 11, the first side wall 41 is moved in the storage width direction until it stops while depressing the lock lever 45, and the locking claw 45*d* of the lock lever 45 is positioned in the notch 43*a* of the guide plate 43 appropriate to the width of the roll paper. As a result, the storage width of the roll paper compartment 11 is determined by the end face 46*a* of the roll paper urging member 46 at the neutral position 46C of the first side wall 41 and by the surface 42*a* of the opposing second side wall 42. Because the urging force of the roll paper urging member 46 does not work at this time, the first side wall 41 can be prevented from being positioned to a position not matching the width of the roll paper 12 as a result of the urging force making it feel like the first side wall 41 met a stop.

If the lock lever 45 is then released, the lock lever 45 returns to the locked position 45A, thereby preventing further movement of the first side wall 41. Because the roll paper urging member 46 is also released from the lock lever 45, the roll paper urging member 46 is returned toward the protruding position 46A by the force of the spring.

The roll paper urging member 46 moves between the protruding position 46A and retracted position 46B and pushes the roll paper 12 to the second side wall 42 side. Variations in the roll paper supply mechanism 10 and shifting when the operator returns the lock lever 45 can result in a slight gap between the roll paper 12 and the first side wall 41 or second side wall 42. There may also be variations in the paper width of the roll paper 12 after the storage width is adjusted.

When there is a gap and when the paper width is narrow, for example, the roll paper urging member 46 protrudes from the neutral position 46C toward the protruding position 46A side and is pressed with predetermined side pressure against the end of the roll paper 12, thus holding the roll paper 12 with no gap therebetween.

When the paper is wide, the roll paper urging member 46 is pushed to the retracted position 46B away from the neutral position 46C by the end of the roll paper 12 so that the roll paper 12 is again held with predetermined side pressure against the end and the side pressure is not excessive.

Gaps between the roll paper 12 and the first side wall 41 or second side wall 42, and variations in the paper width of the roll paper 12, are thus absorbed by the margin or range of movement between the neutral position 46C of the roll paper urging member 46 and the protruding position 46A and retracted position 46B. The roll paper 12 can therefore be constantly held with a predetermined side pressure even when the paper width varies by setting the range of roll paper urging member 46 movement to absorb variations in the paper width of the roll paper 12. The roll paper 12 can therefore be prevented from shifting sideways in the storage width direction, and the roll paper 12 can also be prevented from being held with excessive side pressure.

Furthermore, because the end of the printing paper 12*a* delivered from the roll paper 12 is always conveyed as being aligned with the position of the second side wall 42, the printing position relative to the inkjet head 18 is constant and print quality can be improved.

The roller body 30*e* of the delivery roller 30 can slide in the storage width direction in this embodiment of the invention. As a result, the roller body 30*e* moves with the roll paper 12 when the roll paper 12 resting on the delivery roller 30 is pushed by the roll paper urging member 46 and moved toward the second side wall 42 side. The roll paper 12 can be smoothly set. If the roller body 30*e* does not move, friction between the roll paper 12 and the roller body 30*e* acts as side pressure on the roll paper 12, the side pressure on the roll paper 12 becomes excessive, the transportation load on the paper feed roller increases, and feeding the printing paper 12*a* with the desired precision may not be possible. And, the roll paper 12 is not set easily. However, because the roller body 30*e* of the delivery roller 30 moves in the storage width direction in this embodiment of the invention, an increase in side pressure can be suppressed and this increase in the paper transportation load can be avoided.

At least one embodiment of invention being thus described. It will be obvious that it may be varied in many ways. Such variations are not to be regarded as a departure from the spirit and scope of the invention, and all such modifications are intended to be included within the scope of the following claims.

What is claimed is:

1. A paper supply mechanism comprising:

a roll paper compartment for storing roll paper;

a first side wall that can move and defines one side of the roll paper compartment;

a second side wall that defines the other side of the roll paper compartment;

a lock mechanism that locks the first side wall, the lock mechanism comprising a lock lever that moves between a locked position locking the lock mechanism and the unlocked position where the lock mechanism is released;

a roll paper urging member that urges the roll paper in a storage width direction of the roll paper compartment; and a holding mechanism that operates in conjunction with the lock mechanism and holds the roll a member in a predetermined position, the holding mechanism comprising a lever-side engaging part formed on the lock lever, and an urging member-side engaging part disposed to the roll paper urging member; wherein the roll paper urging member moves between a protruding position where it protrudes a predetermined distance from the first side wall, and a retracted position where it is retracted a predetermined amount;

the holding mechanism holds the roll paper urging member in a position between the protruding position and the retracted position in conjunction with the lock lever moving to the unlocked position; and when the lock lever moves to the unlocked position, the lever-side engaging part engages the urging member-side engaging part and holds the roll paper urging member in the position between the protruding position and the retracted position.

2. The paper supply mechanism described in claim 1, wherein:

the position of the roll paper urging member between the protruding position and the retracted position is a neutral position substantially centered between the protruding position and the retracted position.

3. The paper supply mechanism described in claim 1, wherein:

the second side wall is movable, and has a linkage mechanism that can move the second side wall in the opposite direction as the first side wall in conjunction with movement of the first side wall.

4. The paper supply mechanism described in claim 1, further comprising:

a delivery roller that touches the outside of the roll paper stored in the roll paper compartment, and causes the roll paper to rotate in the feed direction;

wherein the delivery roller includes a roller shaft disposed widthwise to the roll paper compartment, and a roller body attached to the roller shaft so that the roller body can slide a predetermined distance widthwise to the roll paper compartment.

5. The paper supply mechanism described in claim 4, wherein:

movement of the roll paper urging member widthwise to the roll paper compartment and the predetermined distance of the roller body are substantially equal.

6. The paper supply mechanism described in claim 4, further comprising:

a slide cylinder attached to the roller shaft, the slide cylinder being slidable along an axial direction of the roller shaft;

left and right snap rings and that determine the sliding range of the slide cylinder; and a rubber roller body that concentrically surrounds an outside of the slide cylinder.

7. The paper supply mechanism described in claim 6, wherein the slide cylinder is also constantly urged toward the first side wall.

8. The paper supply mechanism described in claim 1, wherein:

when the lock lever is set to the unlocked position so that the first side wall can move, the roll paper urging member is fixed to the first side wall, so that the first side wall can be moved to shift the roll paper to the second side wall side without being affected by the urging force of the roll paper urging member, the first side wall and second side wall can be adjusted substantially to the width of the roll paper, and the lock lever can then be set to the locked position to lock the first side wall.

9. The paper supply mechanism described in claim 1, wherein:

when there is a gap between the roll paper and the first side wall, the roll paper urging member protrudes from the position between the protruding position and the retracted position toward the protruding position side and is pressed with predetermined side pressure against an end of the roll paper, thus holding the roll paper with no gap therebetween; and when the roll paper pushes against the roll paper urging member, the roll paper urging member is pushed to the retracted position away from the neutral position by the end of the roll paper so that the roll paper is held with a predetermined side pressure against the roll paper urging member.

10. The paper supply mechanism described in claim 1, wherein:

when the roll paper is stored in the roll paper compartment and when the lock mechanism is in a locked position, the roll paper can move in the storage width direction in the roll paper compartment.

11. The paper supply mechanism described in claim 10, wherein:

when the roll paper is stored in the roll paper compartment and when the lock mechanism is in a locked position, the roll paper urging member constantly presses against a side of the roll paper such that there is no gap between the roll paper urging member and the side of the roll paper, and such that the roll paper is constantly held with a predetermined side pressure.

12. A roll paper printer having a paper supply mechanism, the paper supply mechanism comprising:

a roll compartment for storing roll paper;

a first side wall that can move and defines one side of the roll paper compartment;

a second side wall that defines the other side of the roll paper compartment;

a lock mechanism that locks the first side wall, the lock mechanism comprising a lock lever that moves between a locked position locking the lock mechanism and an unlocked position where the lock mechanism is released;

a roll paper urging member that urges the roll paper in a storage width direction of the roll paper compartment: and a holding mechanism that operates in conjunction with the lock mechanism and holds the roll paper urging member in a predetermined position, the holding mechanism comprising a lever-side engaging part formed on the lock lever, and an urging member-side engaging part disposed to the roll paper urging member; wherein the roll paper urging member moves between a protruding position where it protrudes a predetermined distance from the first side wall, and a retracted position where it is retracted a predetermined amount;

the holding mechanism holds the roll paper urging member in a position between the protruding position and the retracted position in conjunction with the lock lever moving to the unlocked position; and when the lock lever moves to the unlocked position, the lever-side engaging part engages the urging member-side engaging part and holds the roll paper urging member in the position between the protruding position and the retracted position.

13. The roll paper printer described in claim 12, wherein:

the position of the roll paper urging member between the protruding position and the retracted position is a neutral position substantially centered between the protruding position and the retracted position.

14. The roll paper printer described in claim 12, wherein:

the second side wall is movable, and has a linkage mechanism that can move the second side wall in the opposite direction as the first side wall in conjunction with movement of the first side wall.

15. The roll paper printer described in claim 12, further comprising:

a delivery roller that touches the outside of the roll paper stored in the roll paper compartment, and causes the roll paper to rotate in the feed direction;

wherein the delivery roller includes a roller shaft disposed widthwise to the roll paper compartment, and a roller body attached to the roller shaft so that the roller body can slide a predetermined distance widthwise to the roll paper compartment.

16. The roll paper printer described in claim 15, wherein:

movement of the roll paper urging member widthwise to the roll paper compartment and the predetermined distance of the roller body are substantially equal.

17. The roll paper printer described in claim 12, wherein:

when the roll paper is stored in the roll paper compartment and when the lock mechanism is in a locked position, the roll paper can move in the storage width direction in the roll paper compartment.

18. The roll paper printer described in claim 17, wherein:

when the roll paper is stored in the roll paper compartment and when the lock mechanism is in a locked position, the roll paper urging member constantly presses against a side of the roll paper such that there is no gap between the roll paper urging member and the side of the roll paper, and such that the roll paper is constantly held with a predetermined side pressure.

* * * * *